US006476324B1

(12) United States Patent
Ide et al.

(10) Patent No.: US 6,476,324 B1
(45) Date of Patent: Nov. 5, 2002

(54) JOINING METHOD OF COVERED WIRE, AND COVERED WIRE WITH LOW-MELTING-POINT METAL LAYER THEREIN

(75) Inventors: Tetsuro Ide, Shizuoka-ken (JP); Takashi Ishii, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/575,648

(22) Filed: May 31, 2000

(30) Foreign Application Priority Data

Jun. 4, 1999 (JP) ..... 11-158189

(51) Int. Cl.[7] ..... H01R 4/00
(52) U.S. Cl. ..... 174/84 R; 174/128.1
(58) Field of Search ..... 174/84 R, 72 C, 174/74 R, 128.1, 128.2

(56) References Cited

U.S. PATENT DOCUMENTS

| | | | | | |
|---|---|---|---|---|---|
| 1,691,869 | A | * | 11/1928 | Fowle | 174/128.1 |
| 2,132,235 | A | * | 10/1938 | Green | 174/128.1 X |
| 4,568,797 | A | * | 2/1986 | Binder et al. | 174/128.1 |
| 5,922,993 | A | * | 7/1999 | Ide et al. | 174/84 R |
| 6,027,009 | A | * | 2/2000 | Shinchi | 228/111.5 |
| 6,072,124 | A | * | 6/2000 | Kato et al. | 174/84 R |

FOREIGN PATENT DOCUMENTS

| | | |
|---|---|---|
| GB | 2335803 | 9/1999 |
| GB | 2335804 | 9/1999 |
| GB | 2340674 | 2/2000 |
| GB | 2341497 | 3/2000 |
| JP | 07320842 | 12/1995 |

* cited by examiner

*Primary Examiner*—Chau N. Nguyen
(74) *Attorney, Agent, or Firm*—Finnegan, Henderson, Farabow, Garrett, & Dunner, L.L.P.

(57) ABSTRACT

In a joining method of first and second conductive members together, at least one of the first and second members is a covered wire having an outer periphery of a conductor wire portion covered by a resin-made covering portion, first, connection portion of the first and second members are pinched between resinous chips. At least a part of the conductor wire portion of the covered wire is covered beforehand by a low-melting-point metal layer having a significant value of thickness. Next, the covering portions corresponding to the connection portions are eliminated by heating and pressurization. And both of the resinous chips are then welded to each other, whereby the connection portions are hermetically sealed. The first and second members are electrically conductively connected together by the welding of the low-melting-point metal layer.

17 Claims, 4 Drawing Sheets

JOINING METHOD OF COVERED WIRE, AND COVERED WIRE WITH LOW-MELTING-POINT METAL LAYER THEREIN

CROSS-REFERENCE TO RELATED APPLICATIONS

Not Applicable

STATEMENT REGARDING FEDERALLY SPONSORED RESEARCH

Not Applicable

REFERENCE TO A MICROFICHE APPENDIX

Not Applicable

BACKGROUND OF THE INVENTION

DESCRIPTION OF RELATED ART

Generally, a shield electric wire has a core wire, an inner covering portion that is made of resin and that covers the core wire, braided wires situated on an outer periphery of the inner covering portion, and an outer covering portion that covers the braided wires. The outer covering portion is formed of, for example, heat-resisting PVC (heat-resisting vinyl chloride resin) while the inner covering portion is formed of, for example, cross-linked polyethylene. A grounding electric wire that is connected to the shield wire has a core wire and a covering portion made of resin and covering the core wire.

When connecting the shield electric wire and the grounding electric wire together, a method that is based on ultrasonic welding can be used, too.

FIELD OF THE INVENTION

The present invention relates to a joining method of a covered wire that comprises electrically conductively connecting a covered wire to another member, and a covered wire with a low-melting-point metal layer therein that is used for performing this method.

SUMMARY OF THE INVENTION

However, in a case where merely ultrasonically welding the shield electric wire and the grounding electric wire together, the braided wires and the core wire are merely in contacted relationship with each other. Therefore, there is the possibility that the reliability on the electrical conduction therebetween will be insufficient.

Thereupon, an object of the present invention is to provide a joining method of a covered wire that enables the performance of a highly reliable electrically conductive connection, and a covered wire with a low-melting-point metal layer therein that is used for performing this method.

To attain the above object, in a joining method of the present invention, first, connection portions of first and second conductive members are pinched between resinous chips. At least one of the first and second members is constituted by a covered wire having a conductor wire portion and a resin-made covering portion which covers an outer periphery of the conductor wire portion. At least a part of the conductor wire portion of the covered wire is covered beforehand by a low-melting-point metal layer having a significant value of thickness. Next, the covering portions corresponding to the connection portions are eliminated by heating and pressurization. And both of the resinous chips are then welded to each other, whereby the connection portions are hermetically sealed. The first and second members are electrically conductively connected together by the welding of the low-melting-point metal layer.

According to this method, by the low-melting-point metal layer being dissolved, the first and the second members are electrically conductively connected together. For this reason, an intermetallic-bond portion increases with the result that the reliability on the electrical conduction is enhanced. In addition, there is no need to use a low-melting-point metal layer as a separate piece of parts. Therefore, it is possible to prevent an increase in the cost for parts control, etc. Handling the parts is also easy.

Each of the first and the second members may be constituted by the covered wire having an outer periphery of the conductor wire portion covered by the resin-made covering portion.

The other of the first and the second members may be constituted by a terminal.

A covered wire has a conductor wire portion, a covering portion that covers the conductor wire portion, and a low-melting-point metal layer having a significant value of thickness that covers at least a part of the conductor wire portion. Connection portions of the covered wire and another member are pinched between the resinous chips. The covering portions corresponding to the connection portions are eliminated by heating and pressurization. And both of the resinous chips are then welded to each other, whereby the connection portions are hermetically sealed.

The conductor wire portion may be a plurality of sets of elemental-wire congregations. And each elemental-wire congregation may have a plurality of elemental wires and a low-melting-point metal layer that covers the elemental wires from around the same and that connects these elemental wires to one another. As a result of this, the intermetallic-bond portion further increases with the result that the reliability on the electrical conduction is enhanced.

The proportion of the low-melting-point metal layers based upon a total cross-sectional area of the low-melting-point metal layers and the conductor wire portions may be from 12% inclusive to 18% inclusive. As a result of this, the intermetallic-bond portion more reliably increases with the result that the reliability on the electrical conduction is enhanced.

The low-melting-point metal layer is formed of metal that melts due to the generated heat that is provided at least by ultrasonic welding of the resin. As a result of this, forming the layer can be easily done.

DESCRIPTION OF THE PREFERRED EMBODIMENTS

An embodiment of the present invention will now be explained with reference to the drawings.

Figure 1A:
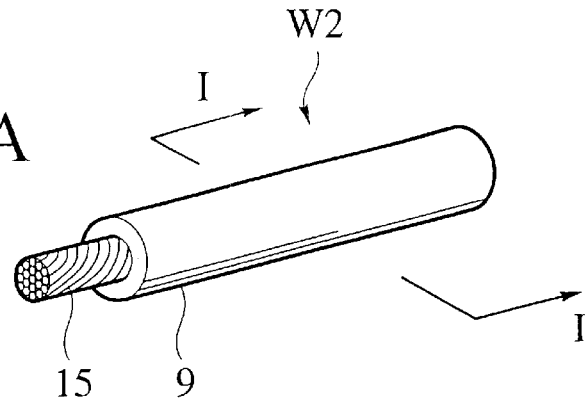
FIG. 1A is a perspective view illustrating a main part of a covered wire according to an embodiment of the present invention.

As illustrated in FIG. 1A, a grounding wire W2 that is constituted by a covered wire with a low-melting-point metal layer therein has a core wire 15 and a covering portion 9 that covers an outer periphery of the core wire 15 and that is made of resin.

The covering portion 9 is formed using material having at least a melt characteristic exhibited through the application of ultrasonic waves, for example material falling under the category of heat-resisting PVC, polyethylene, nylon, etc. as in the case of a covering portion 7 of a shield electric wire W1.

Figure 1B:
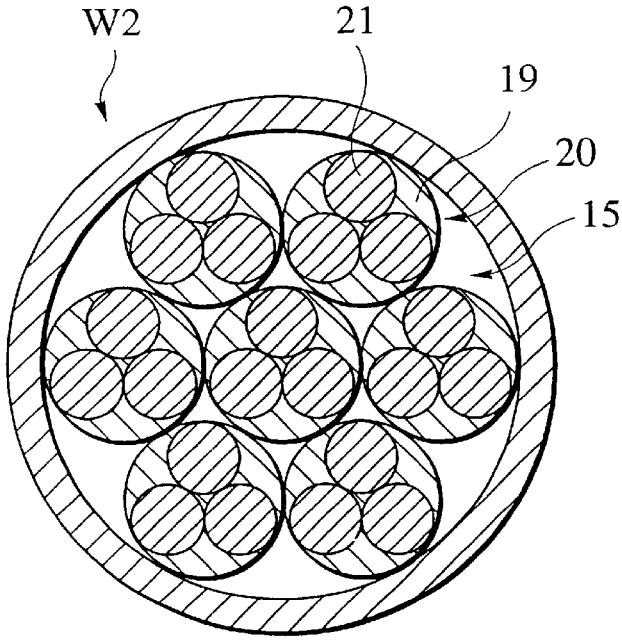
FIG. 1B is an enlarged sectional view taken along a line B—B of FIG. 1A.

As illustrated in FIG. 1B, at least a part of the core wire 15 is covered by a low-melting-point metal layer 19 having a significant value of thickness. Specifically, the core wire 15 is constructed of a plurality of sets, e. g. seven sets, of elemental-wire congregations 20. Each elemental-wire congregation 20 is constructed of a plurality of, e.g. three, elemental wires 21 and a low-melting-point metal layer 19 covering the elemental wires 21 and having a significant value of thickness.

Figure 1C:
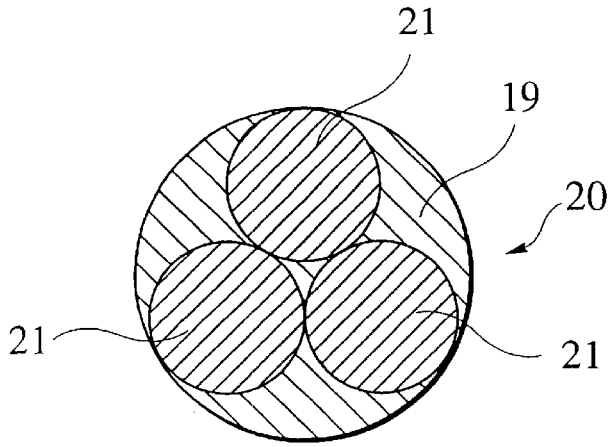
FIG. 1C is an enlarged sectional view illustrating an elemental-wire congregation consisting of a plurality of elemental wires.

The low-melting-point metal layer 19 is formed of metal that melts due to the generated heat obtained at least through the application of ultrasonic welding of resin, for example Sn-plating, solder, or an alloy of Sn and silver. At least in connection portions of the shield electric wire W1 and the grounding wire W2, the proportion of the low-melting-point metal layer 19 based on a total area of a cross section of the core wire 15 as a whole is set to range from 12% inclusive to 18% inclusive. Specifically, as illustrated in FIG. 1C, a line of outer configuration of the low-melting-point metal layer 19 is inscribed to the three elemental wires 21. And the proportion of the low-melting-point metal layer 19 based on a total sectional area of the elemental-wire congregation 20 consisting of the three elemental wires 21 and the low-melting-point metal layer 19 is from 12% inclusive to 18% inclusive.

Next, a joining method of the shield electric wire W1 and the grounding wire W2 will be explained.

Figure 4A:
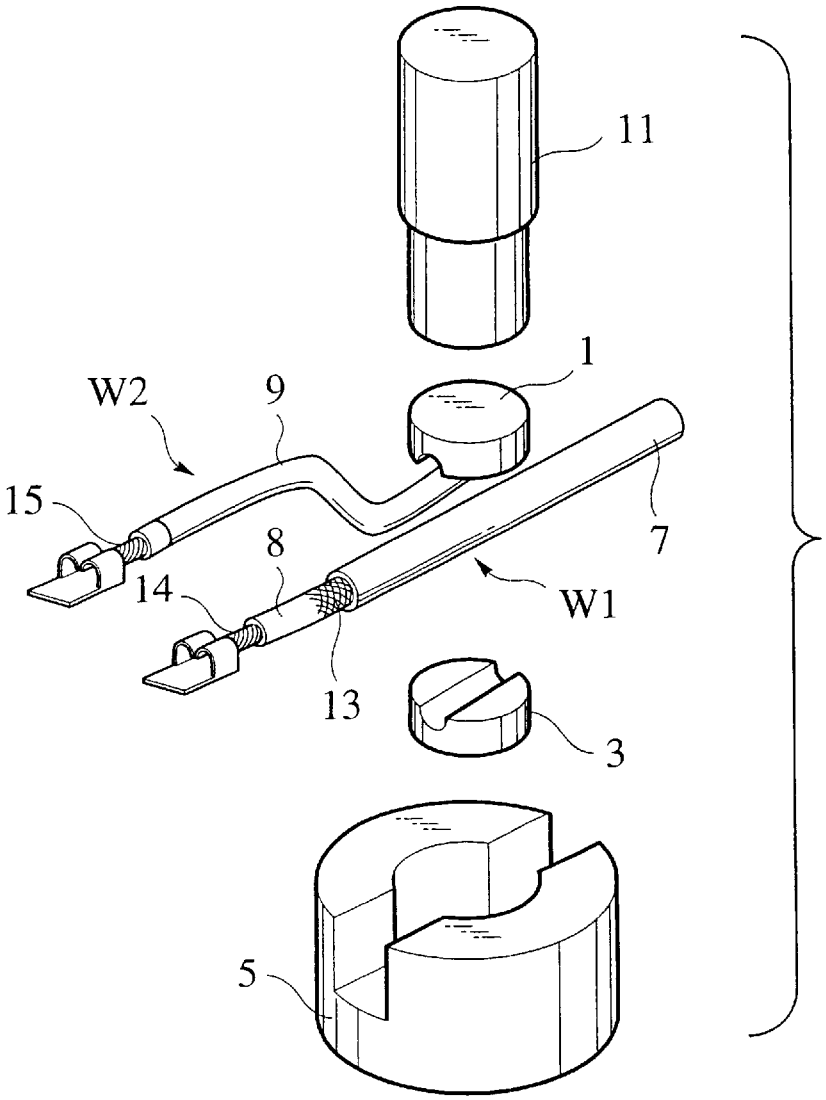
FIG. 4A is a perspective view illustrating a first step.

As illustrated in FIG. 4A, the shield electric wire W1 has a core wire 14 constituting a conductor wire portion, an inner covering portion 8 that covers an outer periphery of the core wire 14 and that is made of resin, braided wires 13 that are situated on an outer periphery of the inner covering portion 8 and that constitute a conductor wire portion, and an outer covering portion 7 that covers an outer periphery of the braided wires 13 and that is made of resin. The inner covering portion 8 is formed of, for example, heat-resisting PVC (heat-resisting vinyl chloride resin) while the outer covering portion 7 is formed of, for example, cross-linked polyethylene.

First, in a first step, connection portions of the both wires W1 and W2 are pinched, or clamped, between a pair of resinous chips 1 and 3. Specifically, one piece of resinous chip 3 is inserted into an anvil 5 and, from over the resinous chip 3, the shield electric wire W1 is inserted in between. And then from over this shield electric wire W1 the grounding wire W2 is further inserted in between. And finally, the other resinous chip 1 is inserted in between.

Next, in a second step, connection portions of the both wires W1 and W2 are pressurized and heated. By doing so, the resin-made covering portions 7 and 9 corresponding to the connection portions are eliminated. And simultaneously the resinous chips 1 and 3 are welded together to thereby hermetically seal the connection portions.

Specifically, a horn 11 is inserted from over the resinous chip 1. Then, vibrations are ultrasonically applied to between the horn 11 and the anvil 5 to thereby cause the generation of heat (cause heating) and simultaneously cause the application of pressure. Due to this generation of heat there are melted the covering portions 7 and 9 of the connection portions. As a result of this, the braided wires 13 of the shield electric wire W1 and the conductor wire portion 15 of the grounding wire W2 are exposed.

Figure 4B:
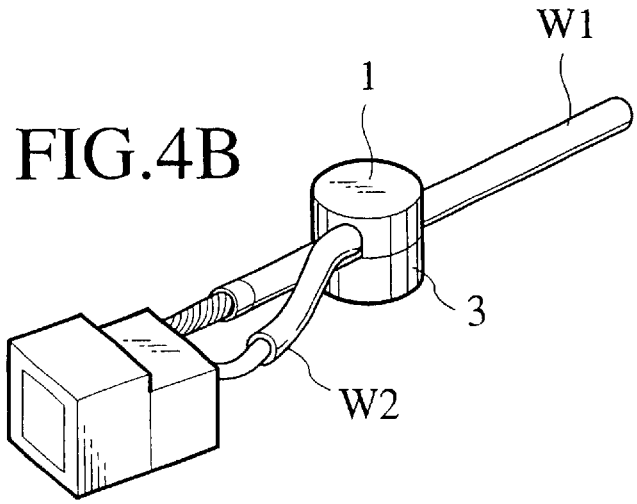
FIG. 4B is a perspective view illustrating a state after the termination of a second step.

Next, the melted covering portions 7 and 9 are extruded from between the resinous chips 1 and 3, by pressurization. Simultaneously, the low-melting-point metal layer 19 is melted due to the generation of heat caused by the ultrasonic vibrations while the braided wires 13 and the elemental wires 21 of the core wire 15 are welded together by the application of pressure. When further continuing to apply the vibrations and pressure, the resinous chips 1 and 3 are melted and these both chips 1 and 3 are welded together. As a result of this, the connection portions are hermetically sealed as illustrated in FIG. 4B.

In this way, the braided wires 13 and the elemental wires 21 are welded together by means of the metal layer 19. Therefore, the amount of intermetallic bond portion between the braided wires 13 and the core wire 15 becomes large, with the result that the reliability on the electrical conductive bond is greatly enhanced.

The low-melting-point metal layer 19 is somewhat caused to splash away by the ultrasonic vibrations. However, since the metal layer 19 is constructed of a layer having a significant value of thickness, the amount of metal plated is large. Further, since the material of the covering portion 9 of the grounding wire W2 has excellent dissolvability, the low-melting-point metal layer 19 does not start to be dissolved until the covering portion 9 is melted and removed. For this reason, there is the merit that the low-melting-point metal layer 19 is unlikely to come out of the connection portions. Namely, the braided wires 13 are reliably welded to the elemental wires 21.

Further, since the low-melting-point metal layer 19 is constructed integrally with the grounding wire W2, there is no need to use solder, etc. as separate pieces of parts. As a result of this, it is possible to prevent an increase in the cost for parts control, etc. Simultaneously, handling the metal layer 19 is also easy.

Figure 2A:
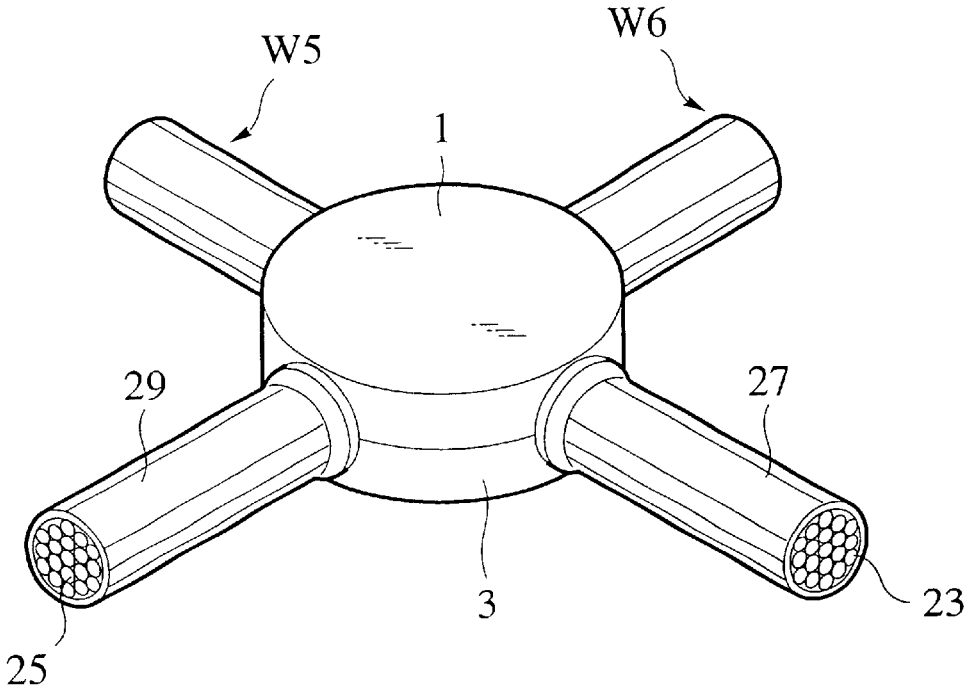
FIG. 2A is a perspective view illustrating a main part of an applied example of the embodiment of the present invention.
Figure 2B:
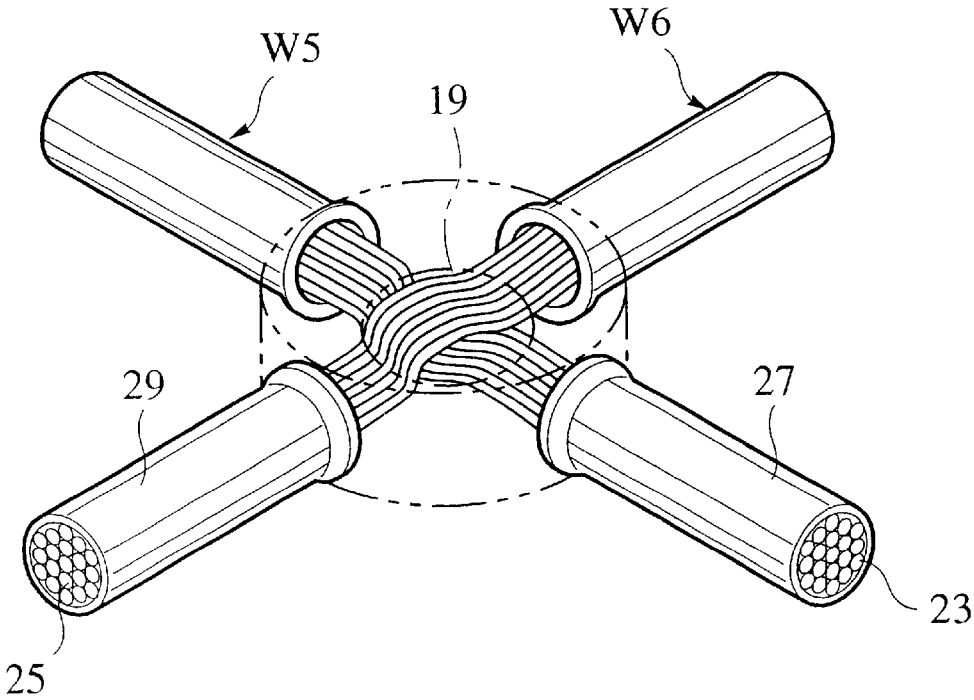
FIG. 2B is a perspective view illustrating a state where resinous chips of FIG. 2A are omitted.

FIGS. 2A and 2B illustrate an applied example of the present invention. In this example, both of members to be electrically conductively connected together are respectively constituted by covered wires W5 and W6. The covered wires W5 and W6 have core wires 23 and 25 constituting the conductor wire portions, and covering portions 27 and 29 that cover outer peripheries of the core wires 23 and 25. Each of the covering portions 27 and 29 is made of resin. By providing the low-melting-point metal layer 19 to each of the covered wires W5 and W6 as in the case of the grounding wire W2 of FIG. 1B, the intermetallic bond portion increases, with the result that the reliability on the electrically conductive bond is greatly enhanced.

Additionally, in the applied example of FIGS. 2A and 2B, even when the low-melting-point metal layer has been provided to either one of the covered wires W5 and W6, the intermetallic bond portion increases, with the result that the reliability on the electrically conductive bond is greatly enhanced. Further, even when the low-melting-point metal layer having a significant value of thickness is applied over a single piece of elemental wire, a significant level of effect can be obtained.

Figure 3A:
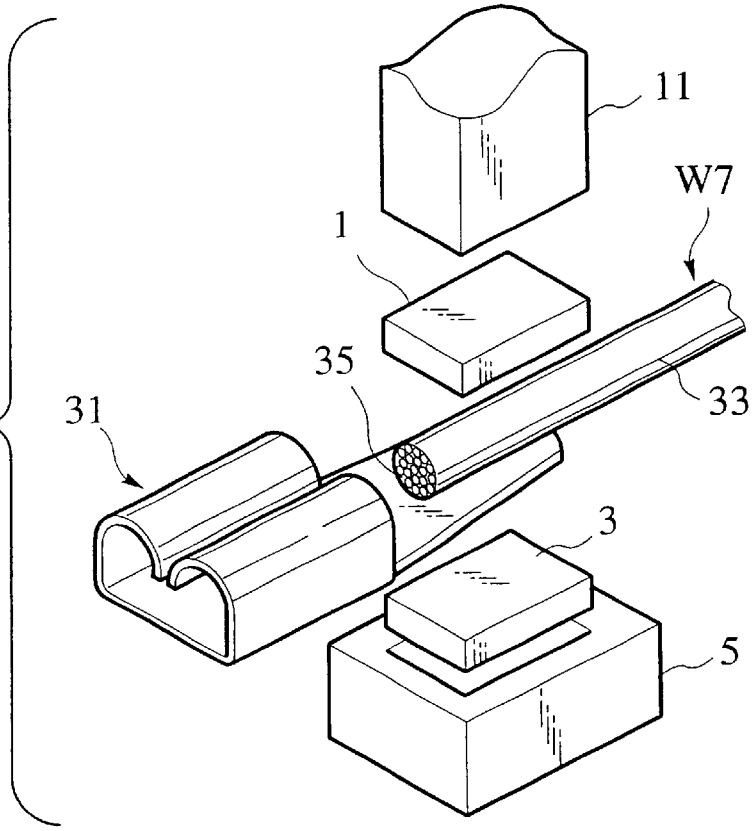
FIG. 3A is a perspective view illustrating another applied example of the embodiment of the present invention.
Figure 3B:
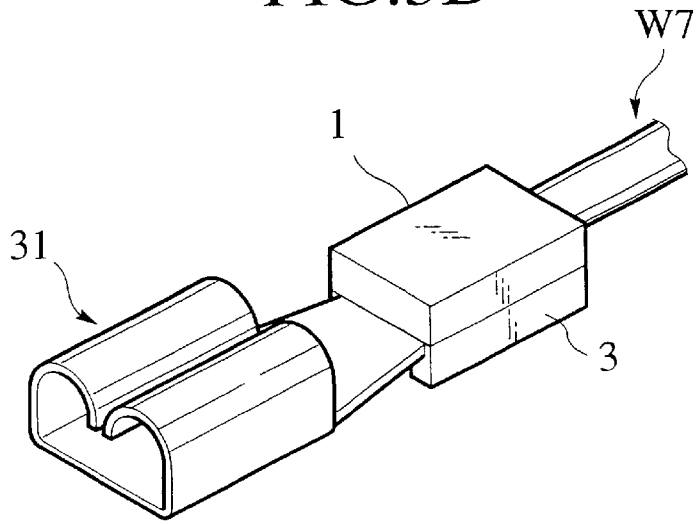
FIG. 3B is a perspective view illustrating the example of FIG. 3A after the same has been formed.

FIGS. 3A and 3B illustrate a case where one of members to be connected together is a covered wire W7 and the other is terminal 31. A covering portion 33 of the covered wire W7 and a core wire 35 constituting the conductor wire portion are respectively constructed, for example, as in the case of the grounding wire W2 of FIG. 1B. And in the core wire 35 there is provided the low-melting-point metal layer. Accordingly, in this applied example as well, the intermetallic bond portion between the covered wire W7 and the terminal 31 increases, with the result that the reliability on the electrically conductive bond is greatly enhanced.

DEPOSIT OF COMPUTER PROGRAM LISTINGS

Not applicable

What is claimed is:

1. A joining method for electrically conductively connecting first and second members together, comprising:

providing the first member comprising a covered wire having a conductor wire portion and a covering portion covering an outer periphery of the conductor wire portion, the conductor wire portion of the covered wire comprising a plurality of elemental-wire congregations, each elemental-wire congregation having a plurality of elemental wires and a low-melting-point metal layer covering around the elemental wires and connecting the elemental wires to each other;

providing the second member having a conductive portion;

pinching connection portions of the first and second members between resinous chips;

pressurizing and heating the connection portions of the first and second members;

eliminating the covering portion corresponding to the connection portion of the first member;

welding the elemental wires of the first member and the conductive portion of the second member by melting the low-melting-point metal layer; and hermetically sealing the connection portions of the first and second members by welding the resinous chips to each other.

2. The joining method according to claim 1, wherein the second member is a terminal.

3. The joining method according to claim 1, wherein the second member is a covered wire comprising a conductor wire portion and a covering portion covering an outer periphery of the conductor wire portion.

4. The joining method according to claim 3, further comprising a step of eliminating the covering portion corresponding to the connection portion of the second member to weld the elemental wires of the first member and the conductor wire portion of the second member.

5. The joining method according to claim 3, wherein the conductor wire portion of the second member comprises a plurality of elemental-wire congregations, each elemental-wire congregation having a plurality of elemental wires and a low-melting-point metal layer covering around the elemental wires and connecting the elemental wires to each other.

6. The joining method according to claim 5, further comprising the steps of:

eliminating the covering portion corresponding to the connection portion of the second member; and melting the low-melting-point metal layer of the second member to weld the elemental wires of the first and second members together.

7. The joining method according to claim 3, wherein the second member further comprises braided wires positioned around an outer periphery of the covering portion and an outer covering portion covering an outer periphery of the braided wires.

8. The joining method according to claim 7, further comprising a step of eliminating the outer covering portion corresponding to the connection portion of the second member to weld the elemental wires of the first member and the braided wires of the second member.

9. The joining method according to claim 1, wherein the connection portions of the first and second members are heated by applying ultrasonic vibrations.

10. The joining method according to claim 1, wherein the eliminating step further comprises the steps of:

melting the covering portion corresponding to the connection portion of the first member; and extruding the melted covering portion out of the resinous chips.

11. A covered wire, comprising:

a conductor wire portion comprising a plurality of elemental-wire congregations, each elemental-wire congregation having a plurality of elemental wires and a low-melting-point metal layer covering around the elemental wires and connecting the elemental wires to each other; and a covering portion covering the conductor wire portion, wherein a total cross-sectional area of the low-melting-point metal layer ranges from 12% inclusive to 18% inclusive relative to a total cross-sectional area of the elemental-wire congregations.

12. The covered wire according to claim 11, wherein each elemental-wire congregation includes three elemental wires.

13. The covered wire according to claim 12, wherein the low-melting-point layer is inscribed to the three elemental wires.

14. The covered wire according to claim 11, wherein the low-melting point metal layer is meltable by applying ultrasonic vibrations thereto.

15. The covered wire according to claim 14, where in the low-melting-point metal layer is formed of tin.

16. The covered wire according to claim 14, where in the low-melting-point metal layer is formed of solder.

17. The covered wire according to claim 14, where in the low-melting-point metal layer is formed of an alloy of tin and silver.

* * * * *

UNITED STATES PATENT AND TRADEMARK OFFICE

CERTIFICATE OF CORRECTION

PATENT NO. : 6,476,324 B1
DATED : November 5, 2002
INVENTOR(S) : Tetsuro Ide and Takashi Ishii It is certified that error appears in the above-identified patent and that said Letters Patent is hereby corrected as shown below:

Column 6,
Line 53, “low-melting point” should read -- low-melting-point --.
Lines 55, 57 and 59, “where in” should read -- wherein --.

Signed and Sealed this

First Day of April, 2003

JAMES E. ROGAN
*Director of the United States Patent and Trademark Office*